US009190790B1

(12) United States Patent
Gongora et al.

(10) Patent No.: US 9,190,790 B1
(45) Date of Patent: Nov. 17, 2015

(54) ELECTRICAL CONNECTOR FOR USE WITH A BUS BAR SYSTEM

(71) Applicant: IDEAL INDUSTRIES, INC., Sycamore, IL (US)

(72) Inventors: Chris Gongora, Sycamore, IL (US); David Best Peterson, Glastonbury, CT (US); Sushil Keswani, Sycamore, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 0 days.

(21) Appl. No.: 14/328,381

(22) Filed: Jul. 10, 2014

(51) Int. Cl.
*H01R 25/00* (2006.01)
*H01R 25/16* (2006.01)

(52) U.S. Cl.
CPC ..... *H01R 25/162* (2013.01)

(58) Field of Classification Search
CPC ..... H01R 25/142; H01R 25/00; H01R 4/48; H01R 25/14; H01R 25/16; E04B 9/006; E04B 9/18
USPC ..... 439/122
See application file for complete search history.

(56) References Cited

U.S. PATENT DOCUMENTS

| | | | | |
|---|---|---|---|---|
| 7,997,910 | B2 * | 8/2011 | Myers et al. | 439/121 |
| 8,770,993 | B2 * | 7/2014 | Gingrich et al. | 439/121 |
| 2013/0237072 | A1 * | 9/2013 | Keswani | 439/110 |

* cited by examiner

*Primary Examiner* — Jean F Duverne
(74) *Attorney, Agent, or Firm* — Greenberg Traurig, LLP

(57) ABSTRACT

A connector includes a first housing section carrying a first conductor element and a second housing section carrying a second conductor element. The first housing section and the second housing section are coupled to each other about a pivot axis such that the first housing section and the second housing section are moveable relative to each other. The first housing section and the second housing section are intended to be moved from a first position to a second position in which the first conductor element of the first housing section and the second conductor element of the second housing section are positioned to make contact with the electrical conductors of a bus bar. In the second position the first housing section and the second housing section are further adapted to engage with each other to thereby inhibit the first housing section and the second housing section from being moved relative to each other back towards the first position.

22 Claims, 17 Drawing Sheets

ELECTRICAL CONNECTOR FOR USE WITH A BUS BAR SYSTEM

FIELD OF THE DISCLOSURE

The present description relates generally to electrical connectors, and more particularly to an electrical connector for use with a bus bar system.

BACKGROUND OF RELATED ART

Bus bar systems and electrical connectors for use in coupling devices to a bus bar system are generally known in the art.

By way of example, U.S. Pat. No. 8,062,042 describes an electrified, framework system for bringing power and/or signals to devices. The electrified, framework system includes at least one longitudinally extending, electrified bus bar. The bus bar has a housing which includes a pair of conductors positioned thereon. Each conductor has a surface which provides a continuous conductive path for attachment of devices. Meanwhile, U.S. Pat. No. 7,997,910 describes connectors for use with the electrified, framework system described in the '042 patent. In particular, the '910 patent describes an electrical connector for coupling the electrical connections of the bus bar to a source device, such as a power supply, and/or a connector for coupling the electrical conductors of the bus bar to a sink device, such as a lamp.

While the devices described in these publications, which publications are incorporated herein by reference in their entirety, generally work for their intended purpose, the following describes an improved connector for use with a bus bar system.

SUMMARY

Described hereinafter is an improved connector for use with a bus bar system.

Generally, the connector includes a first housing section carrying a first conductor element and a second housing section carrying a second conductor element. The first housing section and the second housing section are coupled to each other about a pivot axis such that the first housing section and the second housing section are moveable relative to each other. The first housing section and the second housing section are intended to be moved from a first position to a second position in which the first conductor element of the first housing section and the second conductor element of the second housing section are positioned to make contact with the electrical conductors of the bus bar. In the second position the first housing section and the second housing section are further adapted to engage with each other to thereby inhibit the first housing section and the second housing section from being moved relative to each other back towards the first position.

While the foregoing provides a general description of the subject device, a better understanding of the objects, advantages, features, properties and relationships of the subject device and system will be obtained from the following detailed description and accompanying drawings which set forth illustrative embodiments and which are indicative of the various ways in which the principles of the hereinafter claimed invention may be employed.

BRIEF DESCRIPTION OF THE DRAWINGS

For a better understanding of the subject connector, reference may be had to the following drawings.

DETAILED DESCRIPTION

The following description of example methods and apparatus is not intended to limit the scope of the description to the precise form or forms detailed herein. Instead the following description is intended to be illustrative so that others may follow its teachings.

Figure 1:
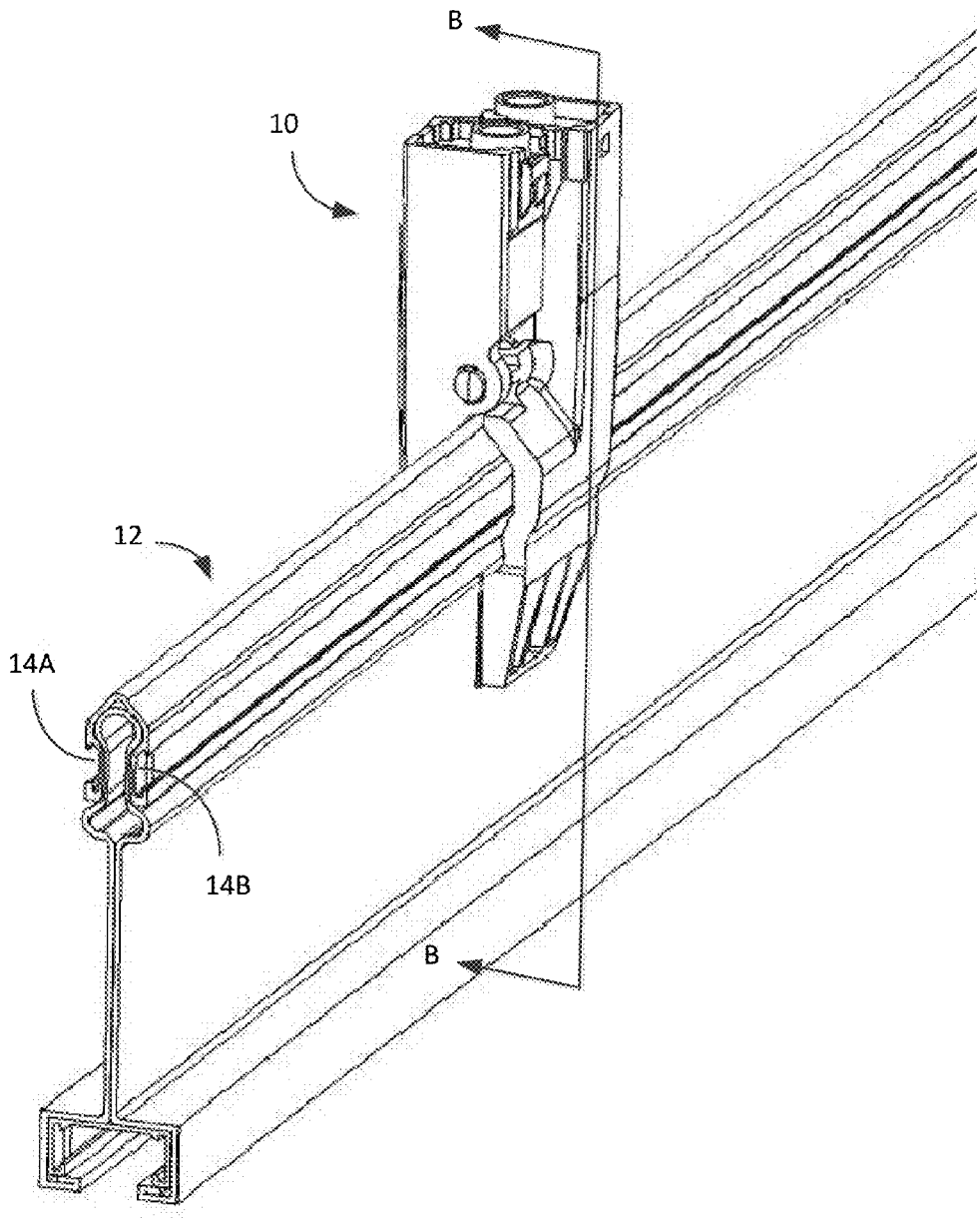
FIG. 1 illustrates an exemplary connector constructed according to the description which follows coupled to an exemplary bus bar.
Figure 2:
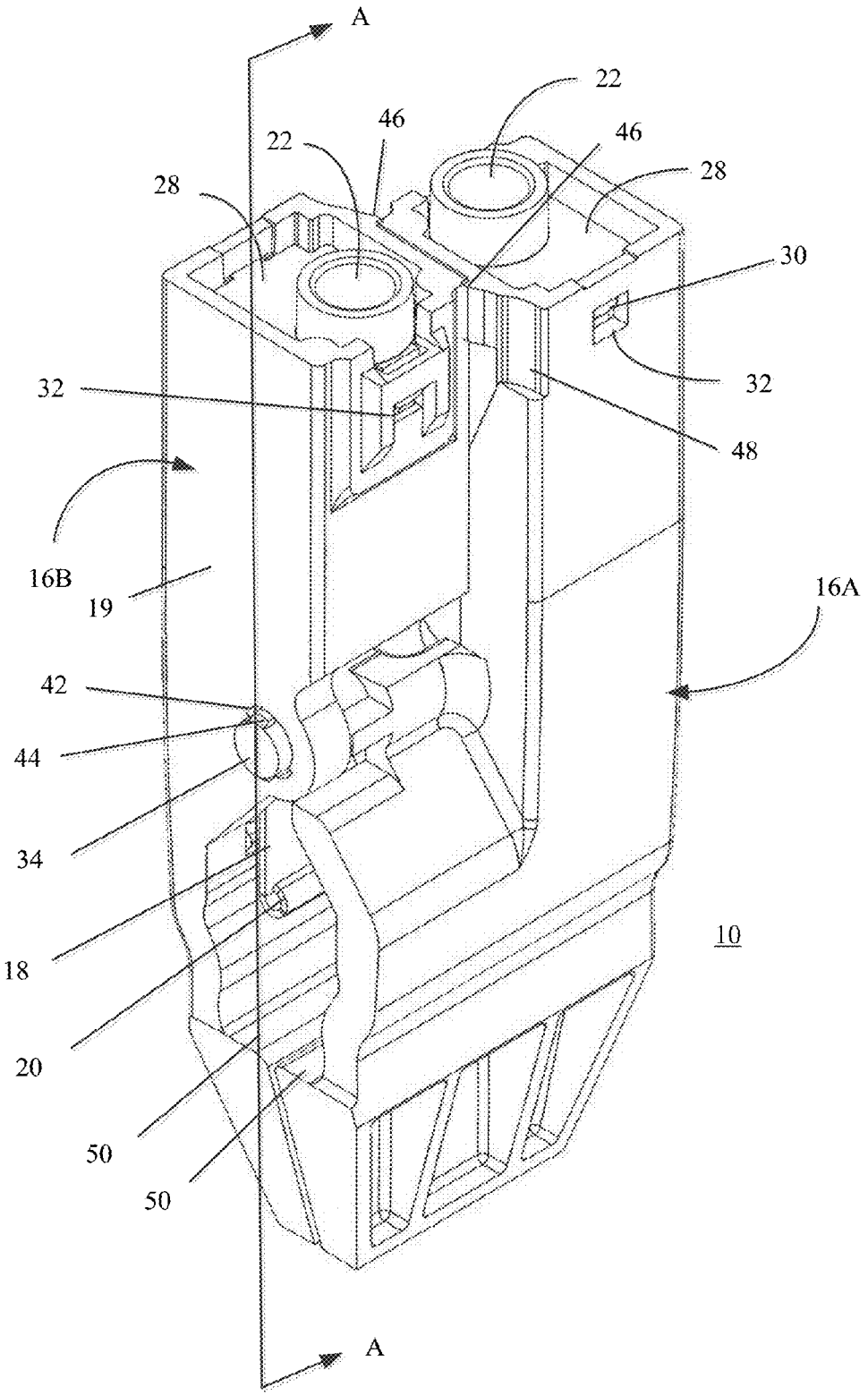
FIG. 2 illustrates an isometric view of the exemplary connector of FIG. 1.
Figure 3:
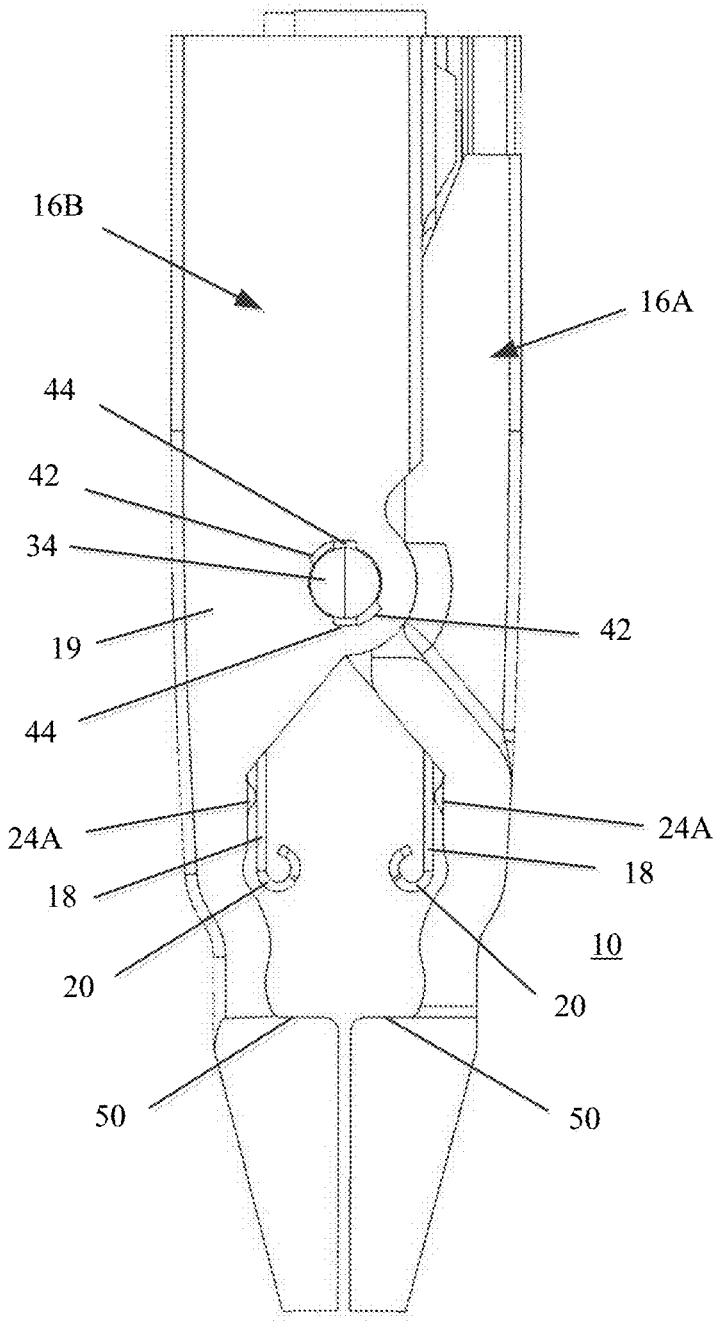
FIG. 3 illustrates a side view of the exemplary connector of FIG. 1.
Figure 4:
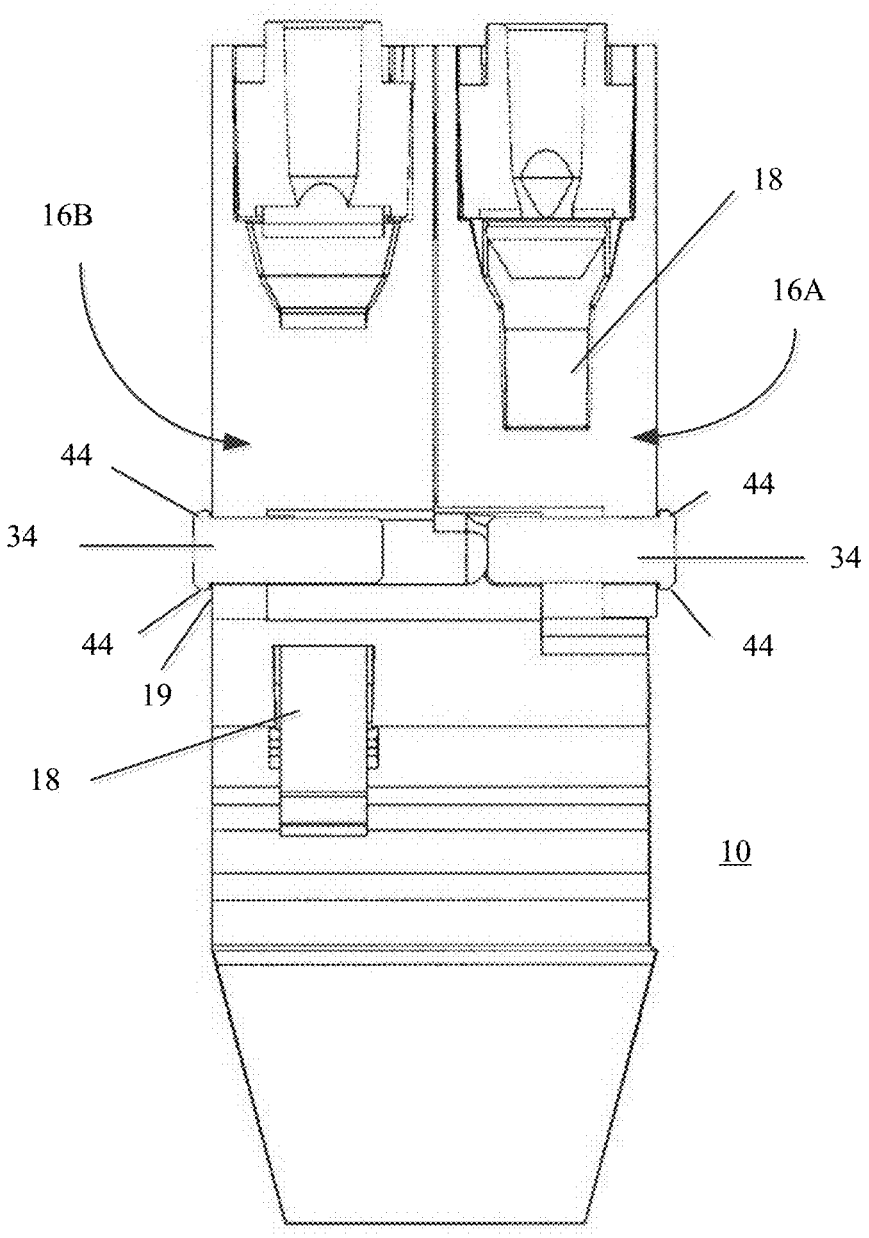
FIG. 4 illustrates a cross-sectional view of the exemplary connector along line A-A of FIG. 2.

With reference to the figures, wherein like reference numerals refer to like elements, a connector 10 for use in electrically coupling a device, such as a power source device or a power sink device, to a bus bar will now be described. As particularly shown in FIG. 1, the exemplary connector 10 is especially adapted for use with a bus bar 12 of the type described in U.S. Pat. No. 8,062,042 and U.S. Pat. No. 7,997,910, i.e., a bus bar having a "bulb shaped" top portion where one side surface of the top portion carries a first conductive strip 14A and the opposite side surface of the top portion carries a second conductive strip 14B and wherein the first conductive strip 14A and the second conductive strip 14B have opposite polarities. While FIG. 1 illustrates the connector 10 being usable with a bus bar 12 of the noted type, it is to be understood that the hereinafter described connector 10 can be provided with other shapes, sizes, and/or arrangements as needed to thereby allow the connector 10 to be usable with other types of bus bars. Accordingly, the exemplary use environment that is illustrated in FIG. 1 is not intended to be limiting.

As shown in FIGS. 1-5, for securely coupling the connector 10 to the bus bar 12, the connector 10 is provided with a pair of pivotally connected and lockable electrical conductor housing elements 16A and 16B. For electrically coupling the connector 10 to the bus bar 12, each of the housing elements 16A and 16B carries an electrical conductor 18 having a first end 20 and a second end 21. The first end 20 of each electrical conductor 18 is arranged in its housing element 16A and 16*b* such that the first end 20 of each of the electrical conductors 18 will be placed into engagement with a corresponding one of the conductive strips 14A and 14B when the connector 10 is, in turn, coupled to the bus bar 12. In this regard, and as will be described in greater detail hereinafter, when the housing elements 16A and 16B are pivoted into position and locked to the bus bar 12, the cooperating housing elements 16A and 16B will function to drive the first end 20 of each conductor 18 into a corresponding one of the conductive strips 14A and 14B. Meanwhile, the second end 21 of the electrical conductor 18 is arranged to provide a means by which a wire, e.g., a wire from a sink or source device, can be coupled to the electrical conductor 18. In the illustrated example, the second end 21 of the electrical conductor 18 is arranged within each of the housing elements 16A and 16B to provide a push-in type wiring connection, e.g., to engage and hold a wire when the wire is inserted into wire receiving openings 22. It will be appreciated that other types of wire connection terminations may also be used for this purpose, such as crimp type terminations, solder type terminations, or the like without limitation. In this manner, when the conductor 10 is installed on the bus bar 12, the electrical conductors 18 can function to provide an electrical coupling between wires of a device (as coupled to the second end 21 of the electrical conductors 18) and the conductive strips 14A and 14B of the bus bar 12 (as coupled to the first end 20 of the electrical conductors 18). In a preferred embodiment, the housing elements 16A and 16B are identically constructed and formed from an electrically insulating material while the electrical conductors 18 are formed using a resilient, electrically conductive material.

Figure 5:
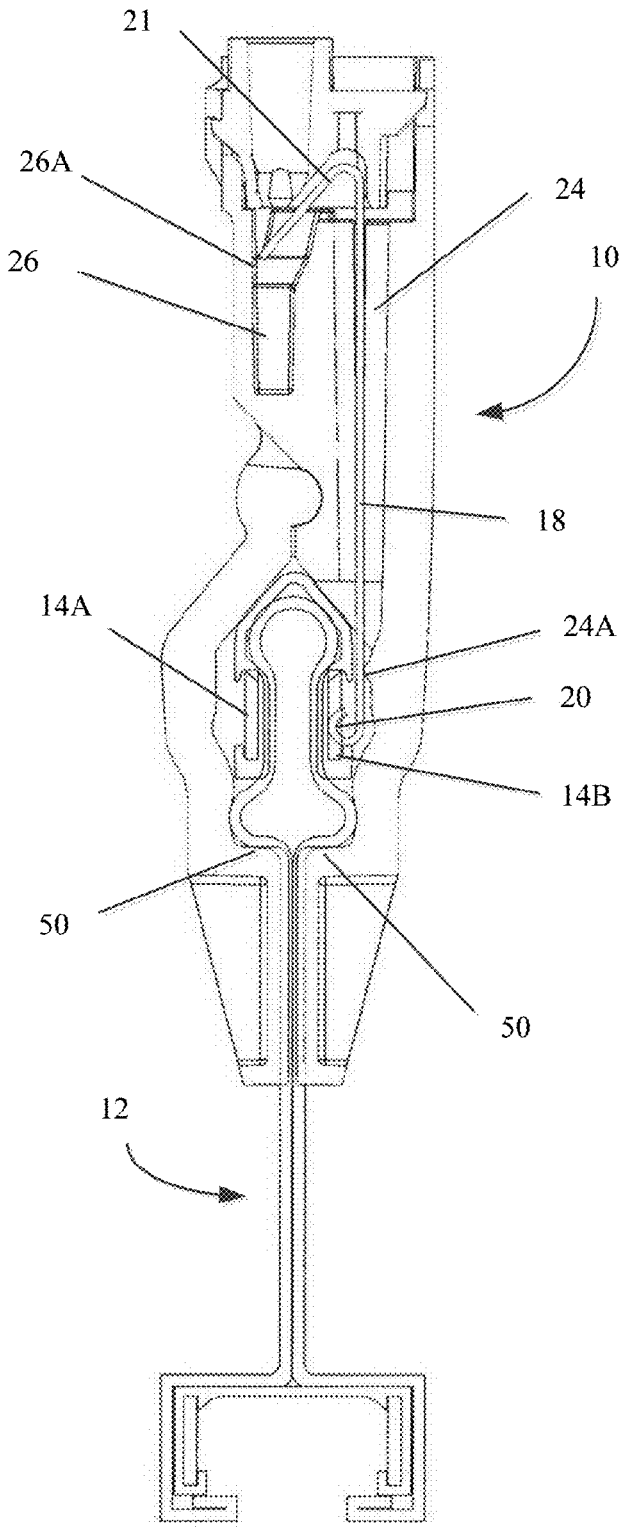
FIG. 5 illustrates a cross-sectional view of the exemplary connector and the exemplary bus bar along line B-B of FIG. 1.
Figure 6:
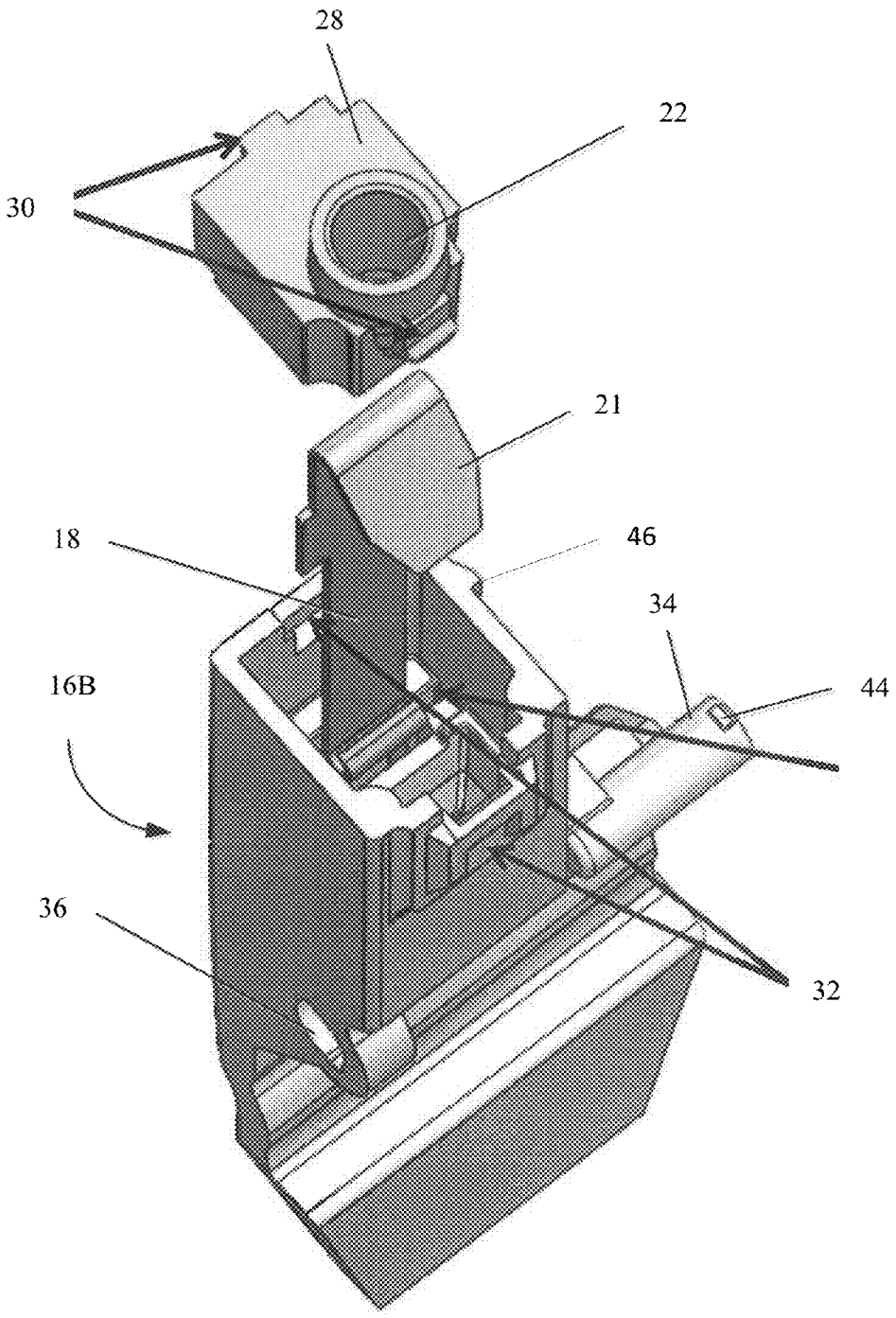
FIG. 6 illustrates an exploded view of an exemplary housing element of the exemplary connector of FIG. 1.
Figure 7:
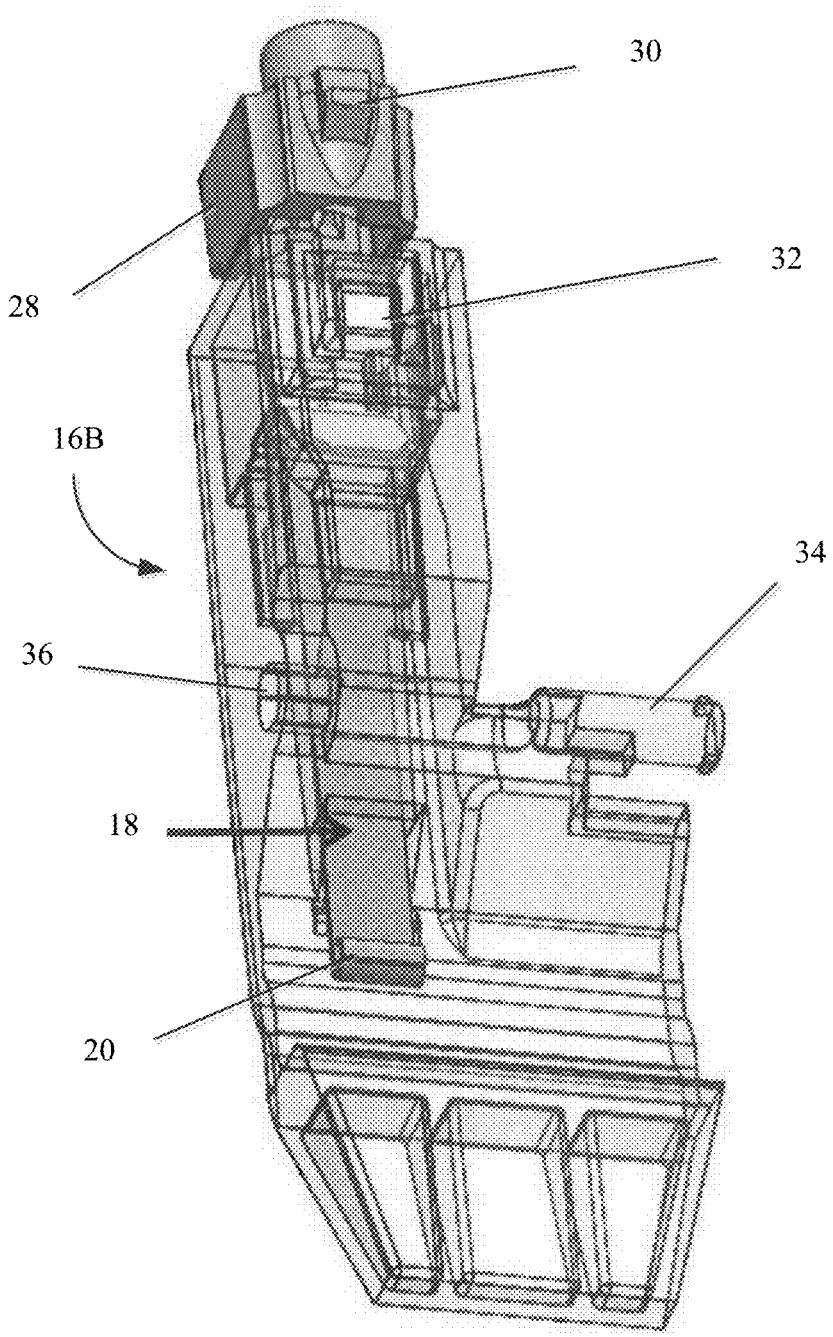
FIG. 7 illustrates an exploded and partial see-through view of an exemplary housing element of the exemplary connector of FIG. 1.
Figure 8:
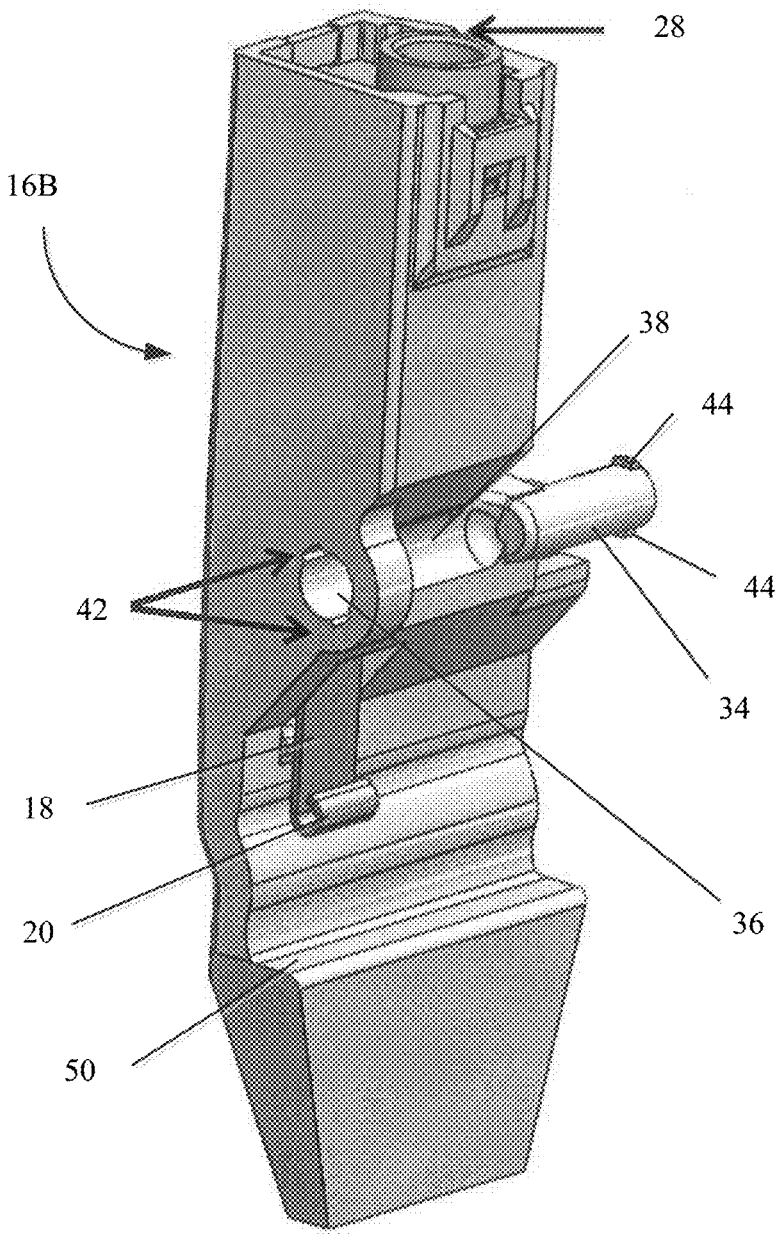
FIG. 8 illustrates an isometric view of an exemplary housing element of the exemplary connector of FIG. 1.
Figure 9:
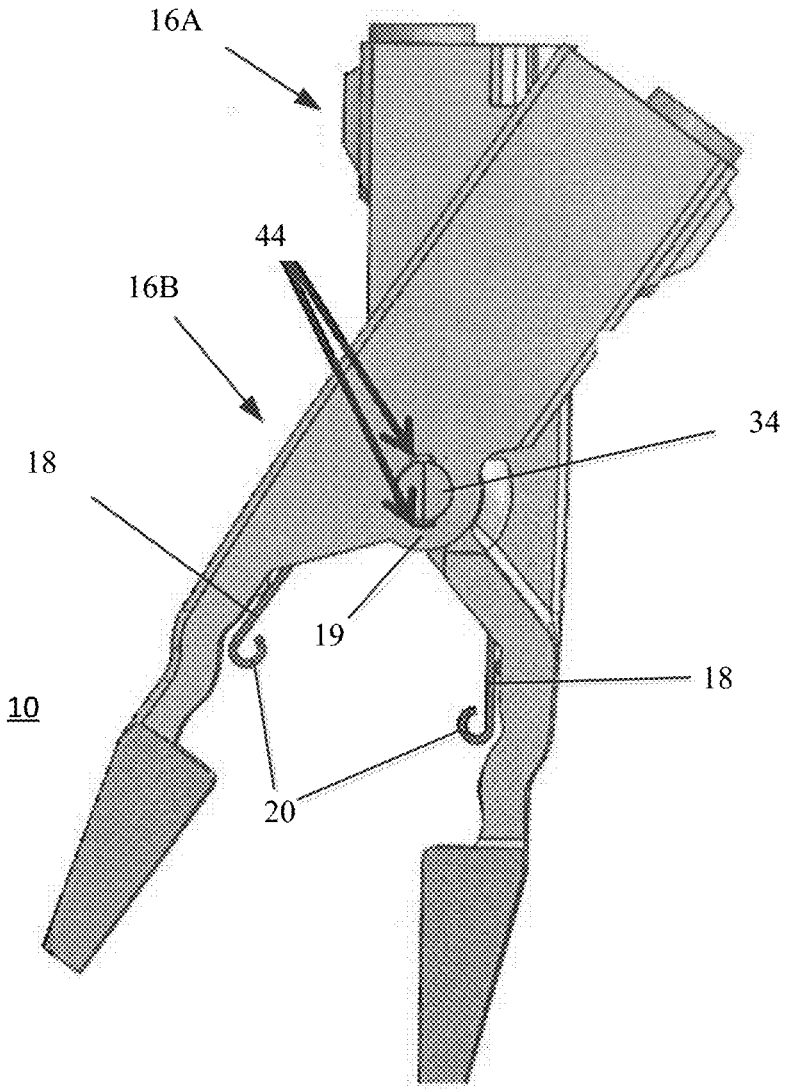
FIG. 9 illustrates a side view of the exemplary connector of FIG. 1 in a first state.
Figure 10:
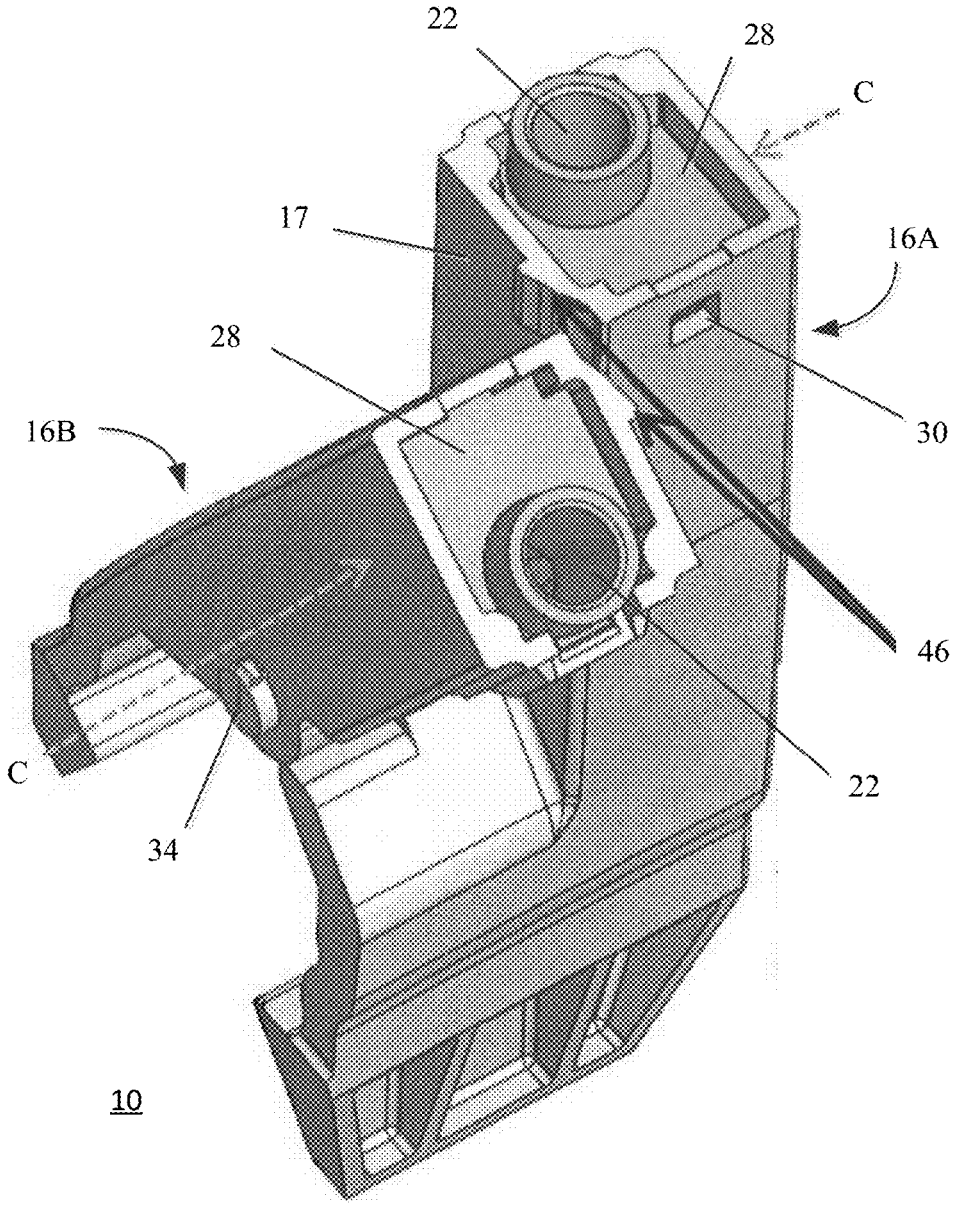
FIG. 10 illustrates an isometric view of the exemplary connector of FIG. 1 in the first state.

Turning to FIGS. 5-7, the electrical contact 18 is positioned within a respective one of the housing elements 16A and 16B by being inserted into a contact receiving channel 24 that is provided in the housing elements 16A and 16B. When the electrical contact 18 is placed within the contact receiving channel 24, the second end 21 of the electrical of the electrical contact 18, which is provided with a bend as shown to facilitate its use as a push-in type termination, will be positioned in a wire receiving channel 26 that is located adjacent to the contact receiving channel 24. In this manner, when a wire is feed into the opening 22 and into the wire receiving channel 26, the second end 21 of the electrical contact 18 will function to trap the wire in position in cooperation with the opposed wall 26A of the wire receiving channel 26 in the manner of a conventional push-in type wire connector.

To maintain the electrical contact 18 within the housing elements 16A and 16B, the housing elements 16A and 16B are provided with an end cap 28 where the end cap 28 includes the wire receiving opening 22 which aligns with the wire receiving channel 24. In the illustrated example, the end cap 28 is provided with a pair of locking elements 30, e.g., one of a tang or a slot, while the housing elements 16A and 16B are provided with a pair of cooperating locking elements 32, e.g., the other of a tang or a slot, to thereby allow the end cap 28 to be snap fit into engagement with the housing element 16A and 16B and to thereby support the electrical contact 18 from the top while locking the electrical contact 18 in position within the housing elements 16A and 16B. Other locking type elements can also be used for this purpose and/or the end caps 28 can be secured to the respective housing elements 16A and 16B via use of other known methods such as welding, gluing, or the like. As further shown in FIG. 5, the contact receiving channel 24 may include a feature 24A for use in urging the exposed first end 20 of the electrical contact 18 into engagement with the conductive strips 14A and 14B of the bus bar 12 when the connector 10 is installed upon the bus bar 12. A good connection between the first end 20 of the electrical contacts 18 and the conductive strips 14A and 14B of the bus bar 12 may be further facilitated by providing the first end 20 of the electrical contacts 18 with a bend as also shown in FIG. 5.

For pivotally coupling the housing sections 16A and 16B to each other, the housing sections 16A and 16B are each provided with a pivot post 34 and a pivot post receiving opening 36 that is axially aligned with the pivot post 34. The pivot posts 24 is preferably integrally formed with its respective housing section 16A and 16B, but can be a separate element attached thereto as desired. As will be appreciated, the pivot post 34 of the housing section 16A is intended to be received in the pivot post receiving opening 36 of the housing section 16B while the pivot post 34 of the housing section 16B is intended to be received in the pivot post receiving opening 36 of the housing section 16A. As shown in FIGS. 4 and 8-10, to assemble the connector 10, the pivot posts 34 of the housing sections 16 A and 16B are first positioned within a groove 38 that is formed between the pivot post 34 and the pivot receiving opening 36 of the opposite one of the housing sections 16A and 16B. The housing sections 16A and 16B are then squeezed together (i.e., are moved in the direction shown by the lines C of FIG. 10) such that the pivot posts 34 of the housing sections 16A and 16B are moved into the pivot post receiving openings 36 of the opposite one of the housing sections 16A and 16B. As further shown in the figures, the pivot receiving openings 36 are provided with one or more keying slots 42 while the pivot receiving posts are provided with one or more cooperating keying features 44. When the housing sections 16A and 16B are initially coupled in the manner described above, the keying features 44 will be passed through the keying slots 42 and the housing sections 16A and 16B will be in a first state in which the housing sections 16A and 16B are angled with respect to each other as particularly shown in FIG. 9. In this manner, when the housing sections 16A and 16B are later rotated with respect to each other for the purposes described below, the interior surfaces of the keying features 44 will engage with the exterior surfaces of the housing sections 16A and 16B that are adjacent to the pivot post receiving openings 36 to thereby prevent the housing sections 16A and 16B from being drawn apart in a direction opposite to that by which they were squeezed together.

Figure 11:
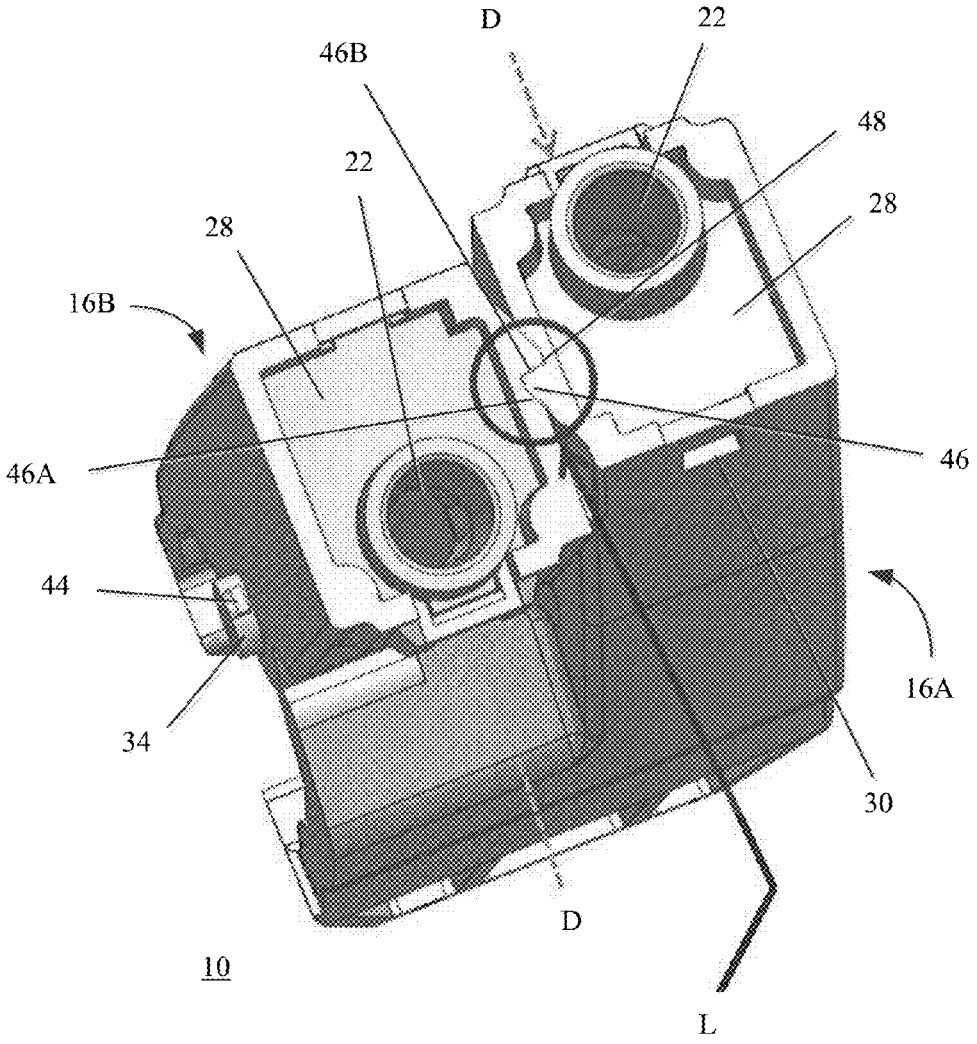
FIG. 11 illustrates an isometric view of the exemplary connector of FIG. 1 in a second state.

To lock the housing sections 16A and 16B to one another, the housing sections 16A and 16B are next rotated with respect to each other (i.e., are moved in the direction shown by the lines D of FIG. 11). In particular, the interiorly disposed surface 17 of the housing sections 16A and 16B are provided with a locking element 46 that is positioned adjacent to a locking element receiving feature 48. In this manner, as the housing sections 16A and 16B are pivoted about the pivot axis provided by the pivot posts 34 for the purpose of placing the housing sections 16A and 16B into a second state as particularly shown in FIGS. 11 and 12, the locking elements 46, which are preferably provided with a cam surface 46A leading to a flat surface 46B, are caused to be passed over one another whereupon the locking elements 46 will be received into the locking element receiving feature 48 of the opposite one of the housing sections 16A and 16B and the flat surfaces 46B of the respective locking elements 46 will cooperate to inhibit the rotation of the housing sections 16A and 16B in the opposite direction, in the general vicinity of the identifier L.

Figure 12:
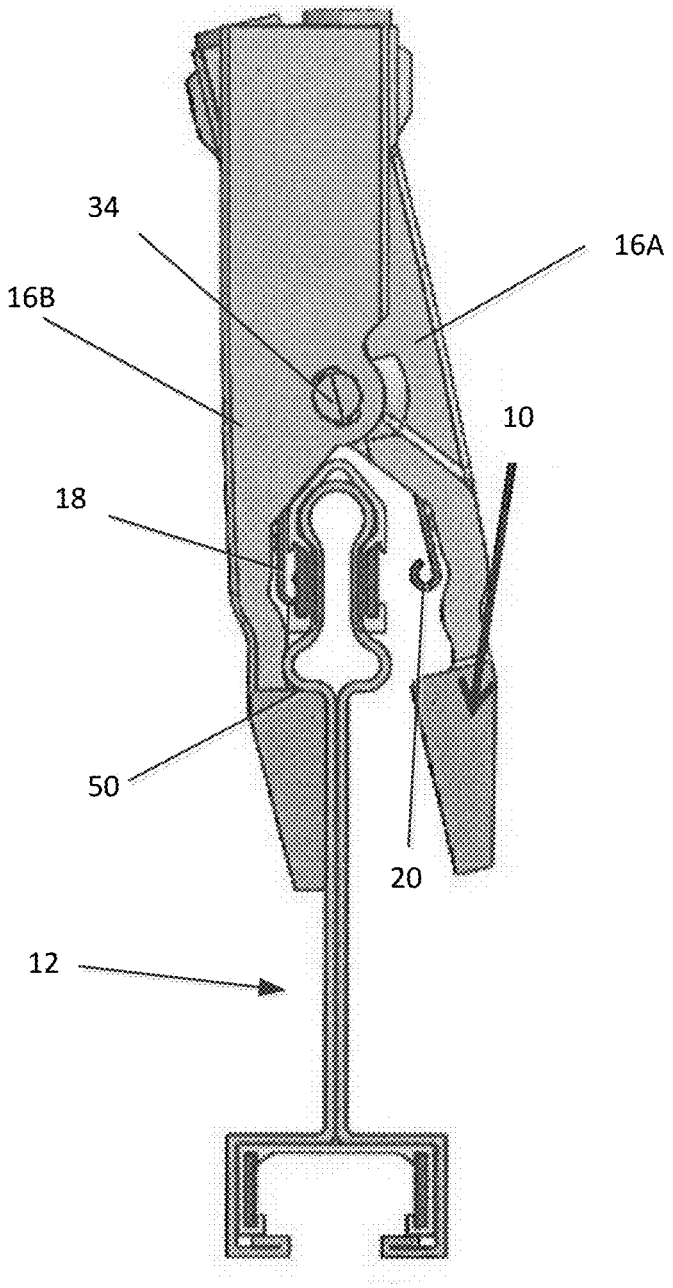
FIG. 12 illustrates a side view of the exemplary connector of FIG. 1 in the second state.

As will also be appreciated, the engagement between the keying features 44 of the pivot posts and the housing sections 16A and 16B described above will function to assist in keeping the housing sections 16A and 16B in this initially locked arrangement in which the connector 10 can be quickly and easily placed upon the bus bar 12 as shown in FIG. 12.

Figure 13:
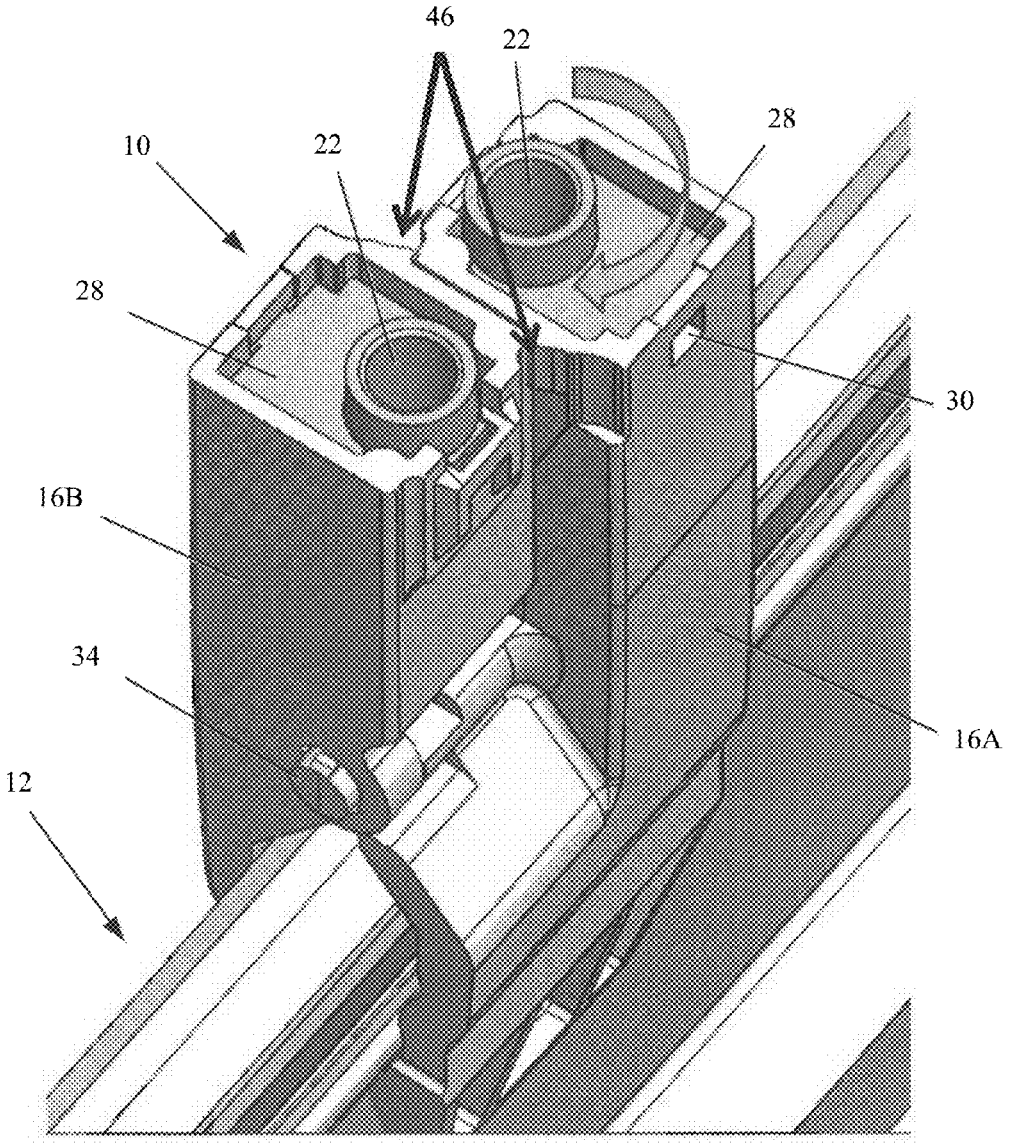
FIG. 13 illustrates an isometric view of the exemplary connector of FIG. 3 in a third state.

Once the connector 10 is positioned upon the bus bar 12, the connector 10 can be locked to the bus bar 12 by further rotating the housing sections 16A and 16B to one another. To this end, the housing sections 16A and 16B may need to be moved with respect to one another, i.e., twisted, to first free the locking elements 46 from the locking element receiving feature 48 of the opposite one of the housing sections 16A and 16B where after the housing sections 16A and 16B are further pushed together to ultimately position the flat surfaces 46B of the locking elements 46 into engagement with an exterior side surface 19 of the opposite one of the housing sections 16A and 16B as shown in FIG. 13. As will be appreciated, the exterior side surface 19 of the housing sections 16A and 16B can be provided with a feature for accepting the locking element 46 of the other one of the housing sections 16A and 16B. Once the locking elements 46 of the housing sections 16A and 16B are engaged with the opposite one of the housing sections 16A and 16B in this manner, the locking elements 46 (and the engagement provided by the keying elements 44) will function to maintain the connector 10 in this third state where it will be locked upon the bus bar 12. As additionally illustrated in the figures, the housing elements 16A and 16B may be provided with bus bar engaging surfaces 50 for preventing the connector 10 from being lifted off of the bus bar 12.

Figure 14:
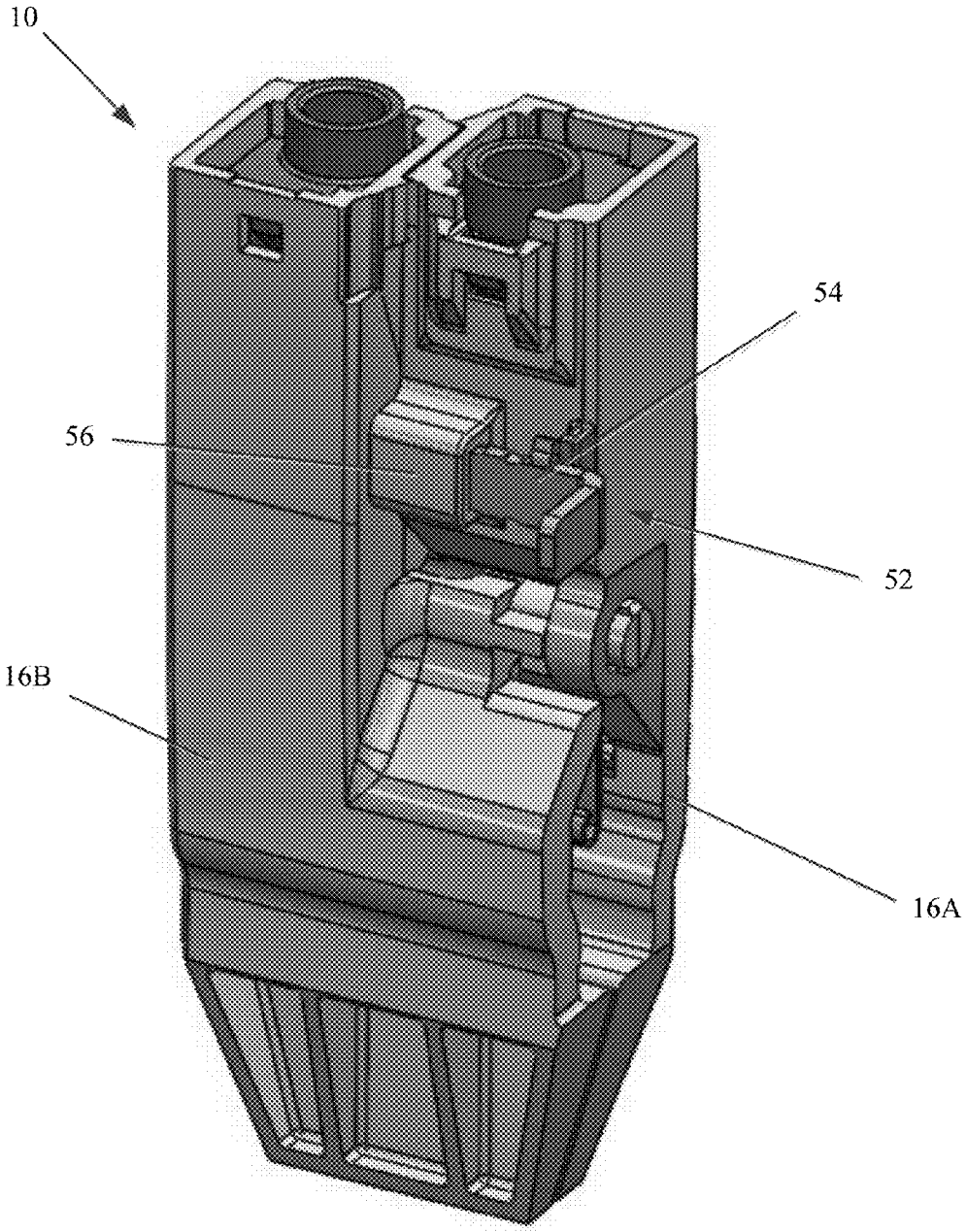
FIG. 14 illustrates an isometric view of the exemplary connector of FIG. 1 showing an example locking mechanism.
Figure 15:
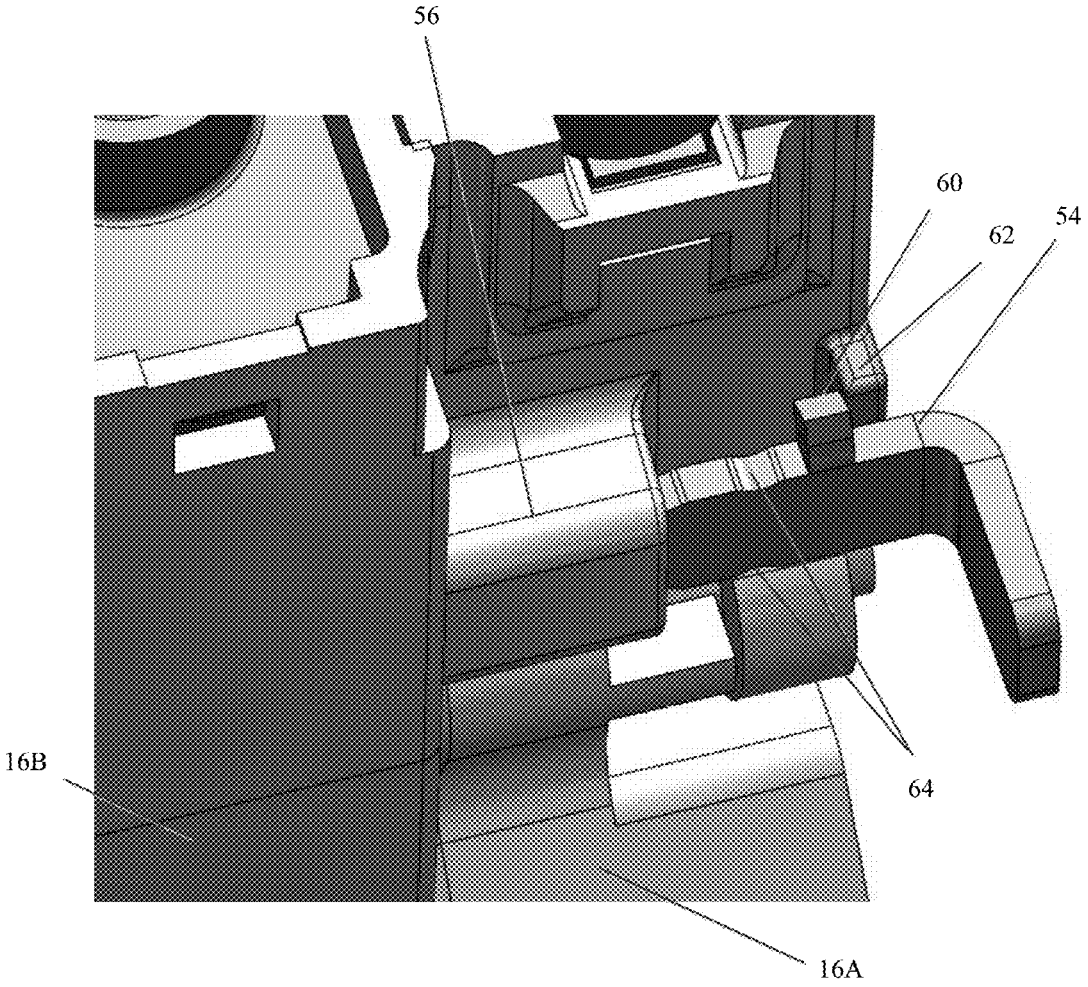
FIG. 15 illustrates an enlarged isometric view of the example locking mechanism of FIG. 14.
Figure 16:
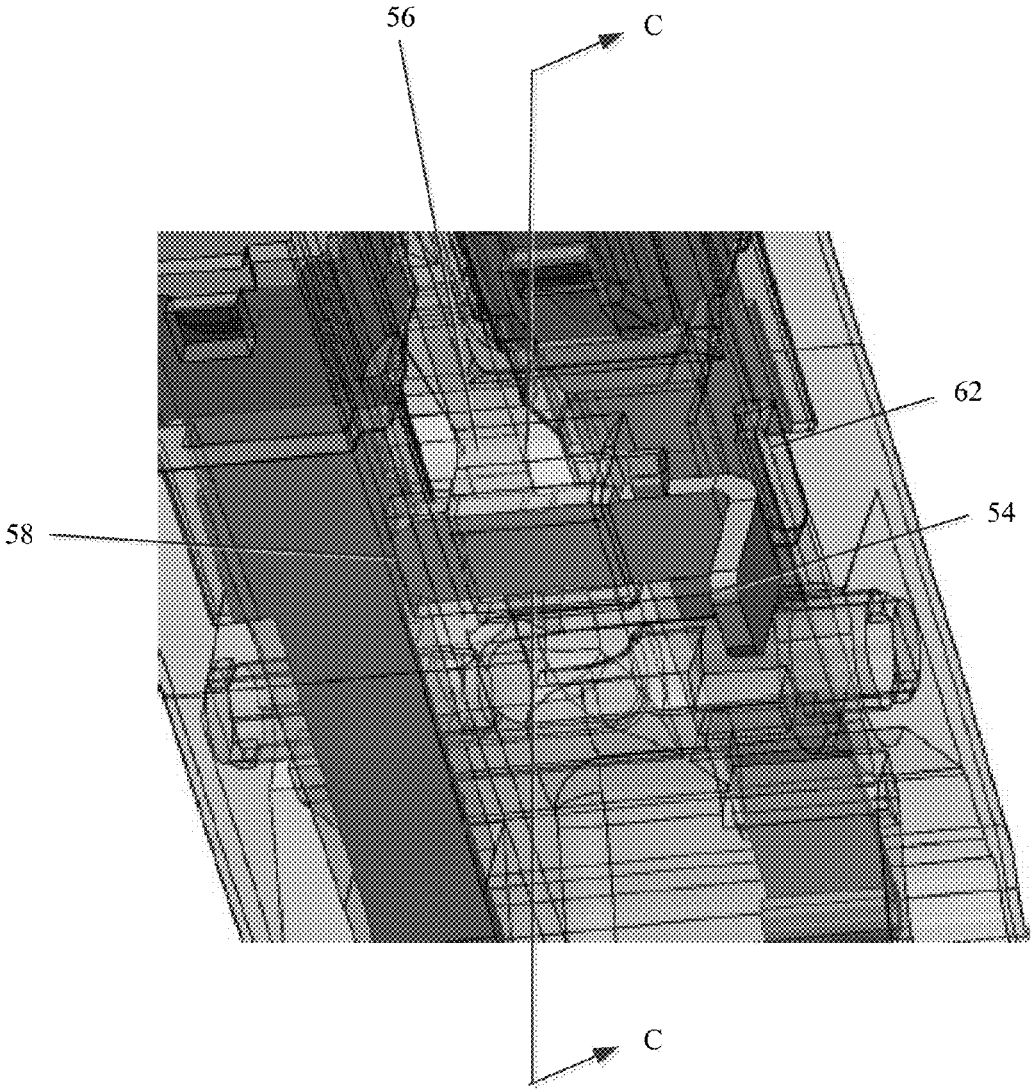
FIG. 16 illustrates an enlarged, isometric, and partial see-through view of the example locking mechanism of FIG. 14.
Figure 17:
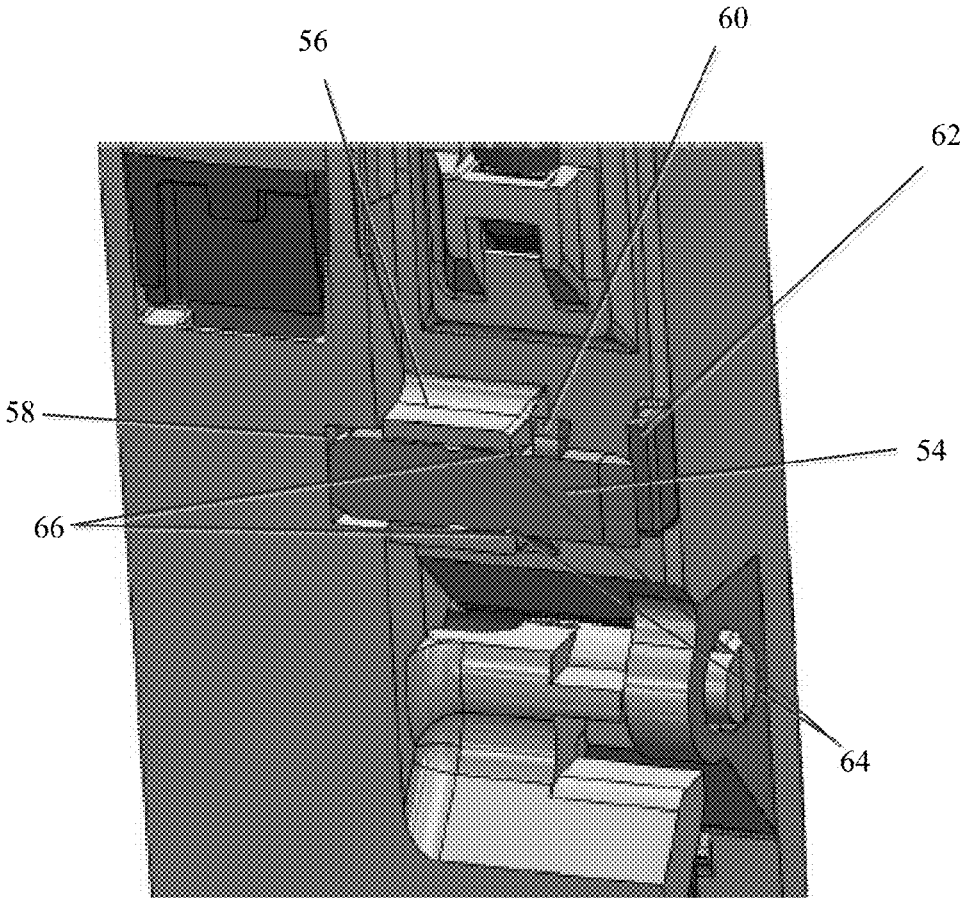
FIG. 17 illustrates a cross-sectional view of the example locking mechanism along line C-C of FIG. 16.

As illustrated in FIGS. 14-17, once the connector 10 is locked upon the bus bar 12, an additional locking mechanism 52 may be utilized to further lock and secure the connector 10 in the closed position and to prevent the connector 10 from being easily lifted off of the bus bar 12. In this instance, the example locking mechanism is a sliding latch-type mechanism comprising a locking pin 54 or similar latch that is slidably coupled to one of the housing elements via a slot 56. In this illustrated example, the locking pin 54 is coupled to the housing element 16A, but it will be understood that the pin 54 may be operably coupled at any suitable location. As best shown in FIGS. 16 and 17, a receiving aperture 58 is formed on the opposite housing element 16B and is sized to receive the locking pin 54 therein during operation of the locking mechanism 52.

In particular, during operation, the example locking pin 54 is slidable between an unlocked position as illustrated in FIGS. 14 and 15, and a locked position as illustrated in FIGS. 16 and 17. In the unlocked position, the locking pin 54 is free of the receiving aperture 58, thereby allowing relative movement between the two housing elements 16A, 16B. In the locked position, however, the locking pin 54 is moved into engagement within the receiving aperture 58, thereby preventing relative movement between the two housing elements 16A, 16B.

The locking pin 54 may also include a limit tab 60 which extends or otherwise is arranged to limit the movement range of the locking pin 54. In this example, the limit tab 60 is arranged on the locking pin 54 such that it contacts a stop 62 arranged on the housing element 16A in the unlocked position, and contacts an outer edge of the slot 56 in the locked position. Still further, the locking pin 54 and slot 56 may be provided with at least one positioning mechanism, such as for example, a positioning detent 64 and tab 66 arranged on the cooperating surfaces of the locking tab 54 and the slot 56 as illustrated in FIGS. 15 and 17. In this example, the positioning mechanism provides a device by which the locking tab 54 is biased and retained in the locked position once the detent 64 and tab 66 are engaged. The positioning mechanism may also provide a visual and physical feedback mechanism to better ensure proper alignment of the locking tab 54 in one of any desired positions. It will be appreciated by one of ordinary skill in the art that the arrangement and form of the elements of the positioning mechanism may vary as desired.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. A connector for use in coupling a device to electrical conductors of a bus bar, comprising:

a first housing section carrying a first conductor element; and a second housing section carrying a second conductor element;

wherein the first housing section and the second housing section are coupled to each other about a pivot axis, wherein the first housing section and the second housing section are moveable relative to each other about the pivot axis from a first position to a second position in which the first conductor element of the first housing section and the second conductor element of the second housing section are positioned to make contact with the electrical conductors of the bus bar, and wherein the first housing section and the second housing section are adapted to engage with each other in the second position to thereby inhibit the first housing section and the second housing section from being moved relative to each other back towards the first position.

2. A connector as recited in claim 1, wherein a longitudinal axis of the first housing section is generally parallel to a longitudinal axis of the second housing section when the first housing section and the second housing section are in the second position.

3. A connector as recited in claim 1, wherein a first end of the first conductor element and a first end of the second conductor element are adapted to contact the electrical conductors of the bus bar and wherein a second end of the first conductor element and a second end of the second conductor element are adapted to engage wires associated with the device.

4. A connector as recited in claim 3, wherein the second end of the first connector cooperates with the first housing section to provide a first push-in type wire connection termination and wherein the second end of the second connector cooperates with the second housing section to provide a second push-in type wire connection terminal.

5. A connector as recited in claim 1, wherein at least one of the first housing section and the second housing section include a locking element for engaging with a locking element receiving feature provided to the other of the first housing section and the second housing section when the first housing section and the second housing section are in the second position.

6. A connector as recited in claim 5, wherein the locking element includes a cam surface and a generally flat surface and wherein the locking element receiving feature comprises an exterior surface of the other of the first housing section and the second housing section and wherein the flat surface of the locking element is caused to be engaged with the exterior surface of the other of the first housing section and the second housing section when the first housing section and the second housing section are in the second potion.

7. A connector as recited in claim 1, wherein each of the first housing section and the second housing section include a locking element for engaging with a locking element receiving feature provided to the other of the first housing section and the second housing section when the first housing section and the second housing section are in the second position.

8. A connector as recited in claim 7, wherein the locking element of the first housing section and the locking element of the second housing section are adapted to engage with each other in a third position that is intermediate the first position and the second position to thereby inhibit the first housing section and the second housing section from being moved relative to each other back towards the first position.

9. A connector as recited in claim 8, wherein the locking elements of the first housing section and the second housing section each include a cam surface and a generally flat surface.

10. A connector as recited in claim 9, wherein the first housing section and the second housing section include a lock element receiving feature for receiving the locking element of the other of the first housing section and the second housing section when the housing sections are in the third position.

11. A connector as recited in claim 1, wherein the first housing section comprises a first pivot post and a first pivot post receiving opening, wherein the second housing section comprises a second pivot post and a second pivot post receiving opening, wherein, in the first position, the first pivot post is disposed within the second pivot post receiving opening and the second pivot post is disposed with the first pivot post receiving opening, and wherein the pivot axis is defined by the first and second pivot posts.

12. A connector as recited in claim 11, wherein the first pivot post and the second pivot post are each provided with a key feature, wherein the first pivot post receiving opening and the second pivot post receiving opening are each provided with key receiving feature, and wherein, in the first position, the key feature of the first and second pivot post is in alignment with the respective key receiving feature of the first and second pivot receiving openings.

13. A connector as recited in claim 12, wherein, when the first housing section and the second housing section are moved from the first position towards the second position, the key feature of the first and second pivot posts will be caused to engage with a surface of the other of the first and second housing sections adjacent to the respective first and second pivot receiving openings.

14. A connector as recited in claim 1, wherein the first housing section comprises a first end cap having a first wire receiving opening generally aligned with a first end of the first conductor element and wherein the second housing section comprises a second end cap having a second wire receiving opening generally aligned with a first end of the second conductor element.

15. A connector as recited in claim 14, wherein the first end cap is adapted to be snap-fit to the first housing section over the first end of the first conductor element and the second end cap is adapted to be snap-fit to the second housing section over the first end of the second conductor element.

16. A connector as recited in claim 15, wherein one of the first end cap and the first housing section is provided with at least one tab element and the other of the first end cap and the first housing section is provided with at least one tab receiving element for providing the snap-fit engagement between the first housing section and the first end cap and wherein one of the second end cap and the second housing section is provided with at least one tab element and the other of the second end cap and the second housing section is provided with at least one tab receiving element for providing the snap-fit engagement between the second housing section and the second end cap.

17. A connector as recited in claim 1, wherein the first housing section and the second housing section are identically constructed.

18. A connector as recited in claim 1, further comprising a locking mechanism operatively coupled to be movable between an unlocked position, wherein relative movement between the first housing section and the second housing section is permitted and a locked position, wherein relative movement of between the first housing section and the second housing section is prevented.

19. A connector as recited in claim 18, wherein the locking mechanism comprises a locking pin arranged on one of the first or second housing sections, and a corresponding receiving aperture arranged on the other of the first or second housing sections, wherein the locking pin is engaged with the receiving aperture when in the locked position.

20. A connector as recited in claim 19, wherein the locking pin further comprises a limit to limit relative movement of the locking pin to the housing section upon which the locking pin is arranged.

21. A connector as recited in claim 19, wherein the locking mechanism comprises a positioning mechanism to bias the locking pin in at least one of the locked or unlocked positions.

22. A connector as recited in claim 21, wherein the locking pin is arranged to slide within a slot, and the positioning mechanism comprises at least one detent arranged on one of the locking pin or slot, and at least one cooperating tab arranged on the other of the locking pin or slot.

* * * * *